United States Patent [19]

Herten

[11] Patent Number: 4,659,001

[45] Date of Patent: Apr. 21, 1987

[54] MACHINE FOR APPLYING ARTICLES OF HARDWARE TO TENSIONED TEXTILE MATERIALS

[75] Inventor: Ernst Herten, Stolberg/Rhld, Fed. Rep. of Germany

[73] Assignee: William Prym-Werke Kg, Stolberg/Rhineland, Fed. Rep. of Germany

[21] Appl. No.: 599,176

[22] Filed: Apr. 11, 1984

[30] Foreign Application Priority Data

Apr. 15, 1983 [DE] Fed. Rep. of Germany ..... 3313682

[51] Int. Cl.[4] ..... A41H 37/00; A41H 37/04

[52] U.S. Cl. ..... 227/153; 227/12; 227/152; 112/113

[58] Field of Search ..... 227/12, 13, 15, 31, 227/152, 153, 154, 149; 112/74, 102, 110, 113, 121.26

[56] References Cited

U.S. PATENT DOCUMENTS

| | | | |
|---|---|---|---|
| 1,208,950 | 12/1916 | Greene et al. | 112/74 |
| 1,217,521 | 2/1917 | Synder | 227/153 |
| 1,632,374 | 6/1927 | Havener | 227/149 |
| 4,376,504 | 3/1983 | Birkhofer | 227/153 X |
| 4,436,238 | 3/1984 | Seki | 227/152 X |

FOREIGN PATENT DOCUMENTS

| | | | |
|---|---|---|---|
| 2926927 | 1/1981 | Fed. Rep. of Germany | 227/31 |
| 0526427 | 9/1940 | United Kingdom | 227/149 |

*Primary Examiner*—Mark Rosenbaum
*Assistant Examiner*—Taylor J. Ross
*Attorney, Agent, or Firm*—Peter K. Kontler

[57] ABSTRACT

A riveting press wherein a vertically movable downwardly yieldable platform supports a selected portion of a textile workpiece between a passive lower tool and a vertically rciprocable upper tool. The upper tool is surrounded by a set of two or more radially outwardly movable and vertically reciprocable grippers having serrated undersides which are moved downwardly and into engagement with the upper side of the workpiece on the platform before the upper tool descends to affix a first component of an article of hardware to the workpiece simultaneously with the application of a second component of such article to the first component and to the workpiece. One such component is supported by the lower tool and the other component is releasably held in sockets of the grippers below the upper tool. The shaft for the upper tool carries a cam which spreads the grippers apart while the grippers engage the workpiece so that the latter is stretched during the interval of application of an article of hardware thereto whereby the portion of the workpiece on the platform is devoid of wrinkles and/or other irregularities in the area around the applied article of hardware.

23 Claims, 9 Drawing Figures

MACHINE FOR APPLYING ARTICLES OF HARDWARE TO TENSIONED TEXTILE MATERIALS

BACKGROUND OF THE INVENTION

The present invention relates to machines for the application of one-piece or composite articles of hardware to sheet- or web-like workpieces, for example, to pieces of textile material which constitute or can be converted or assembled into jeans, jackets and/or other types of garments. Examples of such machines are presses which can be used to apply rivets, clamps, eyelets, hooks, buttons and/or other metallic or plastic articles of hardware to garments or the like so that the applied articles serve a decorative and/or utilitarian purpose.

Many presently known riveting presses employ a platform or analogous means for supporting a selected portion of a piece of textile material or another flexible and penetrable workpiece in a given plane, e.g., in a horizontal plane above a lower tool and below a vertically reciprocable upper tool which is in register with the lower tool. A component of an article of hardware is attached to the portion of the workpiece on the platform in response to downward movement of the upper tool. Alternatively or in addition to the just outlined mode of attachment, a component of an article of hardware can be placed onto the lower tool and is then affixed to the workpiece in response to downward movement of the upper tool. If two components of an article of hardware are to be applied in a simultaneous operation, one of these components penetrates through the workpiece on the platform and is united with the other component. For example, a hollow rivet can be assembled of a first component having a first head and a shank and of a second component having a second head and a sleeve for reception of the shank. Parts of snap fasteners can be affixed in similar fashion, the same as many other articles of small hardware, e.g., rows of buttons next to a selected marginal portion of the workpiece.

If a component of an article of hardware is to be attached to the workpiece from above, such component is held at a level below the vertically reciprocable upper tool by a set of grippers which can yield when the upper tool descends so that the component is disengaged from the grippers and is applied to the workpiece on the platform. The grippers receive successive components of articles of hardware from a suitable magazine by way of a chute and a pusher which latter causes successive components to advance along a relatively short path extending from the discharge end of the chute to the space between the grippers. The grippers are thereupon caused to descend in order to place the freshly received component to a desired position with reference to the portion of the workpiece on the platform, and the upper tool also descends, normally at a rate which is different from that of descent of the grippers, to disengage the component from the grippers and to apply it to the workpiece not earlier than when the component is adequately positioned with reference to the material on the platform.

German Offenlegungsschrift No. 29 15 328 discloses a riveting press of the above outlined character wherein the grippers for the components of articles of hardware simultaneously constitute parts of a safety device which protects the hands of the operator from injury by preventing the prime mover from starting a working cycle when an obstruction (e.g., a finger) is located between the grippers and the workpiece on the platform. Thus, the provision of grippers is desirable and advantageous for several reasons.

A drawback of presently known riveting presses and analogous machines of the above outlined character is that a workpiece which consists of or contains a textile or other foldable and hence deformable material is likely to be wrinkled during placing of a selected portion of such workpiece onto the platform below the vertically reciprocable tool as well as that the grippers themselves are likely to cause the workpiece to develop wrinkles, pleats and/or other irregularities which detract from the appearance of the finished product and/or prevent the application of articles of hardware to predetermined portions of the workpiece. Moreover, the development of wrinkles can affect the reliability of connection between the components of an applied article of hardware and/or the connection between the one and/or the other component of such article of hardware and the workpiece.

OBJECTS AND SUMMARY OF THE INVENTION

An object of the invention is to provide a machine which can be utilized as a means for securing components of articles of metallic or plastic hardware to sheet-like workpieces, especially to provide a press for the application of rivets or the like to webs or sheets of textile material, which is constructed, assembled and operated in such a way that undesirable deformation of the workpiece in and around the region of application of one or more components is prevented in a fully automatic way.

Another object of the invention is to provide a machine of the above outlined character wherein the formation of wrinkles or other irregularities or unevennesses in the material of the workpiece at the article-applying station is prevented in a simple and efficient way without contributing significantly to the bulk, complexity and/or cost of the machine.

A further object of the invention is to provide the above outlined machine with novel and improved means for gripping components of articles of hardware preparatory to application of such components to workpieces and for performing other useful functions without necessitating appreciable changes in their size and/or shape.

An additional object of the invention is to provide a novel and improved method of preparing textile or other flexible materials for the application of articles of hardware thereto.

A further object of the invention is to provide a riveting press with novel and improved means for supporting and imparting motion to grippers which carry components of articles of hardware to the locus of application of such components to workpieces.

Still another object of the invention is to provide a machine of the above outlined character wherein proper positioning of a selected portion of a textile material or the like for the application of one or more components of an article of hardware thereto is effected in automatic response to start of a working cycle which involves the application of one or more components to such selected portion.

The invention is embodied in a machine for securing components of articles of hardware to sheetlike workpieces, particularly in a press for the application of components of rivets or the like to webs or sheets of textile material. The machine comprises means for movably supporting in a predetermined plane that portion of a workpiece which is to be provided with one or more components of an article of hardware, work engaging means disposed at one side of the plane (e.g., above a substantially horizontal plane which is defined by the top surface of a platform or table) opposite the supporting means and including a plurality of grippers which are movable toward and away from the plane and at least one gripper of which is further movable toward and away from each other gripper (e.g., toward and away from the other of two grippers) in substantial parallelism with the plane of the selected portion of the workpiece, drive means for moving the grippers jointly toward and away from the plane of the workpiece and for maintaining the grippers in engagement with the selected portion of the workpiece on the supporting means for a selected interval of time, spreading means for moving the one gripper away from each other gripper while the grippers engage the workpiece so that the grippers stretch or tend to stretch the selected portion of the workpiece on the supporting means during the aforementioned interval, and means for affixing at least one component of an article of hardware to the stretched portion of the workpiece during the aforementioned interval, i.e., while the grippers cooperate to prevent the selected portion of the workpiece from developing wrinkles, folds and/or other irregularities which could affect the appearance of the workpiece and/or the reliability of connection between the component or components of the article of hardware and the workpiece and/or the reliability of connection between several components of such article. As mentioned above, the supporting means can comprise a platform with a substantially horizontal top surface for the selected portion of the workpiece. Such platform can be provided with a preferably vertical passage which terminates at the top surface, and the affixing means can comprise a tool which is installed in the passage of the platform. The latter can be mounted for movement with the workpiece thereon relative to the tool in directions substantially at right angles to the plane of the workpiece thereon. The affixing means in such a machine can further comprise a second tool which is disposed at the one side of the plane of the selected portion of the workpiece on the supporting means opposite and in register with the tool in the passage of the supporting means, and means for reciprocating the second tool toward and away from the tool in the passage so that a component which is placed between one of the tools and the selected portion of the workpiece is affixed to such portion of the workpiece in response to movement of the second tool toward the passage. The reciprocating means for the second tool can comprise means for moving the second tool relative to the engaging means, i.e., relative to the grippers. The second tool is or can be at least substantially surrounded by the grippers. For example, if the engaging means comprises two grippers, each such gripper can extend along an arc of approximately 180 degrees around a vertical shaft which carries the second tool. The grippers can include means (e.g., sockets) for releasably holding a component of an article of hardware in front of the second tool so that, when the second tool is moved toward the plane of the selected portion of the workpiece, it removes the component from the holding means and applies the removed component to the selected portion of the workpiece on the supporting means. The aforementioned drive means can be arranged to move the grippers jointly toward and into engagement with the selected portion of the workpiece prior to removal of a component from the holding means of the grippers, and the spreading means is then arranged to maintain the one gripper away from each other gripper while the second tool removes a component from the holding means and affixes the removed component to the selected portion of the workpiece on the supporting means.

At least one of the grippers can comprise a block-shaped or otherwise configurated carrier and a work-engaging shoe which is articulately (preferably pivotably) connected with the carrier. Such shoe can be provided with a work-engaging face which preferably exhibits projections or protuberances in the form of ribs and/or teeth to thus ensure that the shoe is more likely to properly engage and stretch and/or spread the selected portion of the workpiece prior to and/or during application of one or more components of an article of hardware.

The spreading means can include cam means, means for moving the cam means relative to the one gripper and follower means provided on the one gripper and arranged to track the cam means with attendant movement of the one gripper away from each other gripper during certain stage or stages of movement of the cam means. The means for moving the cam means can include or form part of the means for moving the reciprocable tool with reference to the supporting means. Such moving means can comprise a shaft which is at least partially surrounded by the carriers of the grippers, and the cam means can constitute a sleeve or another enlarged portion which is provided on (e.g., affixed to or made integral with) the shaft. Such enlarged portion can have a conical front end face which can engage a complementary face on the follower means of the one gripper when the shaft causes the reciprocable tool to move toward the selected portion of the workpiece on the supporting means.

The means for coupling the grippers to the drive means can include resilient means which secures the one gripper to the drive means. Such resilient means can comprise a leaf spring which urges the one gripper toward each other gripper but is caused to yield when the spreading means is actuated to move the one gripper away from each other gripper.

The drive means can comprise a rotary cam which transmits motion to the aforementioned cam means of the spreading means.

The novel features which are considered as characteristic of the invention are set forth in particular in the appended claims. The improved machine itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
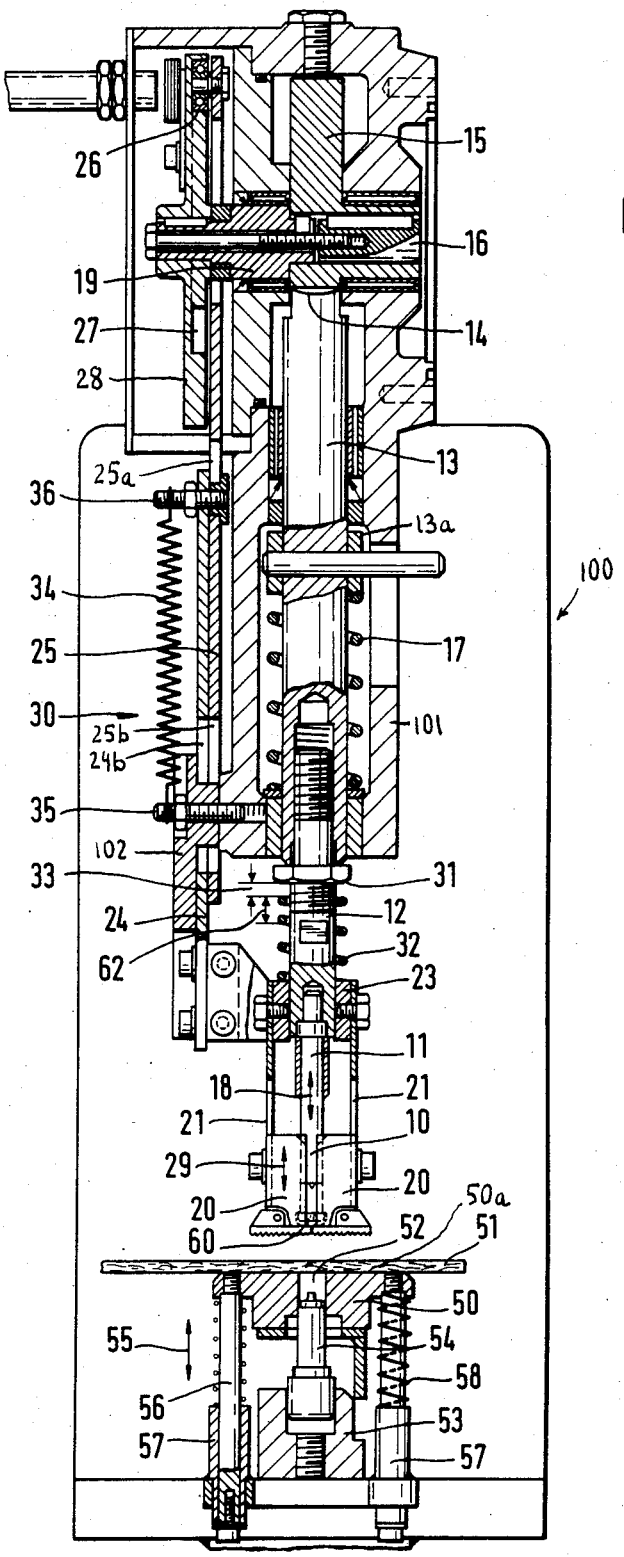
FIG. 1 is a partly front elevational and partly vertical sectional view of a machine which constitutes a riveting press and embodies one form of the invention.

The machine which is shown in the drawing is an upright press which can be used for the application of metallic or synthetic articles of hardware to webs, sheets or panels of textile material, metallic foil, cardboard, synthetic plastic material and/or a combination of such materials. The articles of hardware which are applied to the workpiece can constitute one-piece components (e.g., one-piece rivets each of which has a head and a shank and is to be provided with a second head) or composite (normally two-piece) articles of hardware each having a first component at one side and a second component at the other side of the workpiece. Such components are integrally or separably connected to each other to form a two-piece rivet or the like, and at least one thereof is caused to penetrate through the workpiece as a result of its treatment in the press. The articles of hardware can constitute rivets, hooks, snap fasteners, eyelets, buttons or analogous articles which are to be applied to webor sheet-like workpieces for decorative and/or utilitarian purposes. The treatment of components in the press can include upsetting, bending, hammering, forging, expanding and/or other types of deformation which lead to conversion of a single component into a one-piece article of hardware or to the assembly of several components into a composite article of hardware. Examples of components which can be assembled with one another and simultaneously attached to a workpiece are hollow rivets wherein a shank carries a first head, wherein a sleeve carries a second head and the shank is caused to penetrate into the sleeve after it has passed through the layer or layers of the workpiece. Furthermore, one-piece rivets each having a shank and a single head can be assembled with washers to that the shank extends through the workpiece and the head and the washer are disposed at the opposite sides of the workpiece. Still further, a shank which carries a head at one end thereof can be caused to penetrate through the layer or layers of the workpiece and to enter into and be united with a cap. The articles of hardware can be affixed in one or more rows adjacent to one or more marginal portions of a sheet or web of textile material (e.g., a piece of cloth which is to be converted into or constitutes jeans, a jacket or another garment) or they can be applied in a different distribution. Each workpiece can be provided with a single article of hardware or with two or more.

The machine which is shown in the drawing comprises a frame 100 which supports a fixedly mounted lower tool 54 and a reciprocable upper tool including a ram 10 which is in register with the lower tool 54 and is at least partially surrounded by a work engaging device including two grippers 20. The upper tool 10 (hereinafter called ram for short) is mounted at the lower end of a vertical shaft 11 which is connected to the lower end portion of a reciprocable plunger 13 by an adapter 12. The upper end portion 14 of the plunger 13 constitutes a follower which tracks the peripheral surface of a disc cam 15 which is driven by the output shaft 16 of an electric motor, not shown. The shaft 16 is rotatably mounted in the upper portion of the frame 100. A coil spring 17 reacts against a frame member 101 and bears against a sleeve **13*a* on the plunger 13 so that the follower 14 is in permanent contact with the peripheral surface of the cam 15. The double-headed arrow 18 indicates the directions of reciprocatory movement of the plunger 13 and ram 10 under the action of the moving means including the cam 15 and spring 17**.

Figure 5:
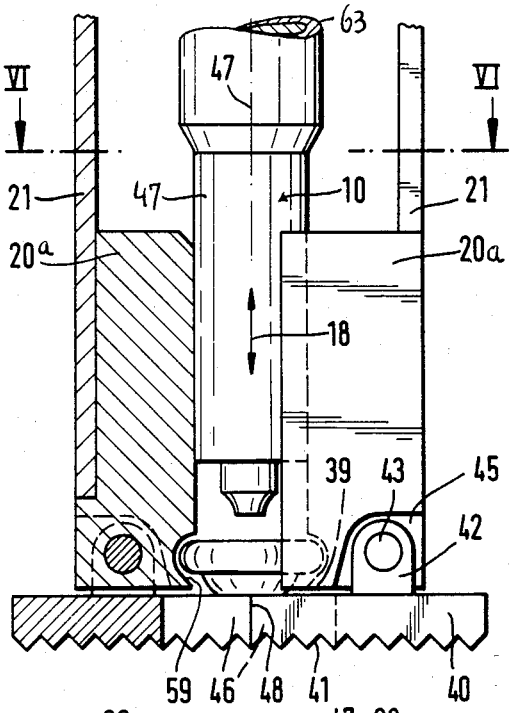
FIG. 5 is an enlarged partly front elevational and partly vertical sectional view as seen in the direction of arrows from the line V—V of FIG. 6 and illustrates the grippers and the means for spreading the grippers apart upon engagement of their shoes with the material of the workpiece on the platform.
Figure 6:
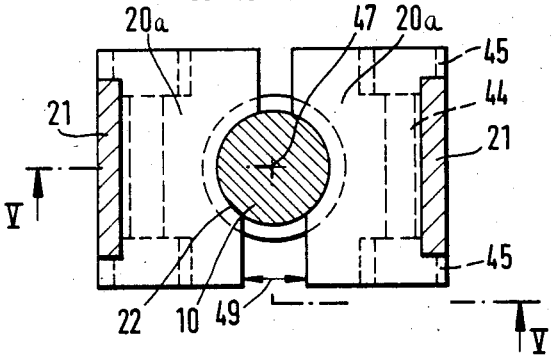
FIG. 6 is a horizontal sectional view as seen in the direction of arrows from the line VI—VI of FIG. 5.

As can be seen in FIGS. 5 and 6, the grippers 20 comprise block-shaped carriers **20*a* having substantially semicylindrical internal surfaces 22 which normally abut against the complementary cylindrical external surface of the ram 10. Each carrier 20*a* is attached to the lower end portion of a discrete coupling device in the form of a leaf spring 21 which biases the respective internal surface 22 against the ram 10. The upper end portions of the leaf springs 21 are secured to a head 23 which surrounds and is slidable relative to the adapter 12 and is secured to the lower end portion of a lower vertical motion transmitting member 24 in the form of an elongated bar which constitues one element of the drive means for the grippers 20, namely of the means for moving the grippers up and down with and/or relative to the ram 10. The upper portion of the motion transmitting member 24 is vertically movably connected to the lower portion of a second vertical motion transmitting member 25. The upper end portion of the member 25 carries a roller follower 26 which is received in an endless groove 27 machined into or otherwise formed in one side of a rotary disc cam 28 on the shaft 16. Thus, the member 25 is compelled to move up or down whenever the cam 28 rotates and the center of curvature of that portion of the groove 27 which happens to receive the follower 26 is not located on the axis of the shaft 16. The cam 28 is actually mounted on a hub 19 which is coaxial with and is affixed to the shaft 16. The directions of reciprocatory movement of the motion transmitting members 24, 25 and grippers 20 are indicated by a double-headed arrow 29. Owing to the configuration and angular relationship of the cams 15 and 28 (note the upper portions of FIGS. 3 and 2), the reciprocatory movements of the ram 10 are out of phase with those of the grippers 20** for reasons which will be explained below.

The head 23 constitutes a retainer for the lowermost convolution of a coil spring 32 whose uppermost convolution is normally spaced apart from an axially adjustable stop 31 in the form of a nut meshing with a portion of the adapter 12 below the frame member 101. When the machine is idle, the uppermost convolution of the spring 32 is spaced apart from the underside of the stop 31 by a distance 33 which can be varied by rotating the stop 31 relative to the adapter 12.

The grippers 20 and the parts 23, 24, 25 of the drive means therefor constitute elements of a safety device 30 which protects the fingers of the operator from injury if the operator happens to place one or more fingers into the space 61 (FIG. 2) below the grippers 20 before the motor for the shaft 16 is started in order to move the grippers downwardly toward the upper side of a portion of a flexible sheet- or web-like workpiece 51 on the horizontal top surface 50*a* of a work supporting device here shown as a platform 50 which is movably mounted on the lower portion of the frame 100. The mode of operation of the safety device 30 is analogous to that which is disclosed in German Offenlegungsschrift No. 29 15 328. This safety device further includes a tension spring 34 having a lower end portion secured to a post 35 on the frame member 101 and an upper end portion secured to a post 36 which is affixed to the upper end portion of the motion transmitting member 24 and has a portion extending into a vertical slot 25*a* of the upper motion transmitting member 25. The length of the slot 25*a* determines the extent to which the member 25 is reciprocable with reference to the member 24 when the latter is held against downward movement by an obstruction (e.g., a finger) below one or both grippers 20. The member 25 invariably pulls the member 24 upwardly when the member 25 is caused to move upwardly by the cam 28 and the post 36 is located in the lower end portion of the slot 25*a*. The members 24, 25 can be in requisite frictional engagement to ensure that the member 24 shares the movements of the member 25 in the absence of an obstruction in the space 61 between the gripper or grippers 20 and the workpiece 51. The spring 34 tends to move the member 24 downwardly, and the members 24, 25 have additional vertical slots 24*b*, 25*b* which receive a portion of a guide 102 attached to the frame member 101.

The safety device 30 further includes two electric contacts 37, 38 (FIG. 2) which are respectively mounted on the motion transmitting members 24, 25. When the post 36 is located in the lowermost portion of the slot 25*a*, the contacts 37, 38 engage each other and complete the circuit of the motor which drives the shaft 16 for the cams 15 and 28. If the member 24 is held against downward movement with the member 25 by an obstruction below one or both grippers 20, the member 25 descends relative to the member 24 and the contact 38 is disengaged from the contact 37 to effect immediate stoppage of the motor, i.e., further descent of the member 25 is interrupted so that the safety device 30 effectively prevents injury to a careless or inexperienced operator.

As can be seen in FIGS. 5 to 9, the lower end faces 39 of the block-shaped carriers 20*a* of the grippers 20 are adjacent to shoes 40 whose undersides constitute work-engaging faces and are provided with serrations 41 in the form of ribs, teeth or the like. The serrations 41 extend substantially at right angles to the plane of FIG. 5 or 8, namely at right angles to the directions in which the grippers 20 are movable toward and away from the ram 10 under the action of and against the opposition of the respective leaf springs 21. Each of the shoes 40 has two upwardly extending eyelets 42 received with some clearance in cutouts 45 in the lower end faces of the respective carriers 20*a* and secured to the respective carriers 20*a* by horizontal pintles 43 defining pivot axes for angular movements of the shoes 40 toward and away from the end positions which are shown in FIG. 5 and in which the side faces 48 of such shoes abut against each other. The pintles 43 are received in registering horizontal bores 44 of the respective carriers 20*a*. The central portions of the side faces 48 are formed with semicircular cutouts 46 which together define a round passage (see FIG. 7) for a component 60 (FIG. 4) of an article of hardware which is received in and releasably held in holding means or sockets 59 machined into the inner sides of the carriers 20*a* at a level slightly above the shoes 40. The center of the passage which is defined by the cutouts 46 is located on the axis of the shank or shaft 47 of the ram 10. The leaf springs 21 ensure that the side faces 48 of the shoes 40 abut against each other when the semicylindrical internal surfaces 22 of the carriers 20*a* are adjacent to the cylindrical peripheral surface of the shank 47. The shoes 40 assume such positions whenever the shank 47 extends slightly above the upper end faces of the carriers 20*a*, namely when these carriers are not acted upon by a spreading device which includes a sleeve-like cam 63 forming an integral part of or being affixed to the shank 47 of the ram 10. The character 49 denotes in FIG. 6 the minimal distance between the two grippers 20.

The platform 50 constitutes a means for supporting at least a selected portion of the workpiece 51 in the plane of its top surface 50*a*, and such platform is formed with a vertical passage 52 (e.g., a through bore bounded by a cylindrical internal surface of the platform) which receives the upper part of the lower tool 54. The lower part of such tool is affixed to a base 53 which is detachably or permanently installed in the frame 100. The workpiece 51 can consist of one or more layers of textile, metallic and/or synthetic plastic material, cardboard, even paper or a combination of two or more different materials. The platform 50 is movable up and down in directions indicated by a double-headed arrow 55 under the action or against the opposition of coil springs 58 surrounding vertical columns 56 whose upper end portions are affixed to the platform and whose lower end portions are slidable in suitable sleeve bearings 57 of the frame 100. The coil springs 58 tend to urge the platform 50 upwardly against one or more suitable stops of or on the frame 100 so that, when the machine is idle, the platform 50 assumes the upper end position which is shown in FIG. 1. At such time, the ram 10 and the grippers 20 are spaced apart from the workpiece 51 on the platform 50 so that the workpiece can be readily shifted relative to the top surface 50*a* for the purpose of placing a selected portion of such workpiece into the space between the passage 52 and the ram 10.

The platform 50 can be depressed by the shoes 40 of the grippers 20 through the medium of the selected portion of the workpiece 51, namely that portion of the workpiece which overlies the top surface 50*a*.

Figure 3:
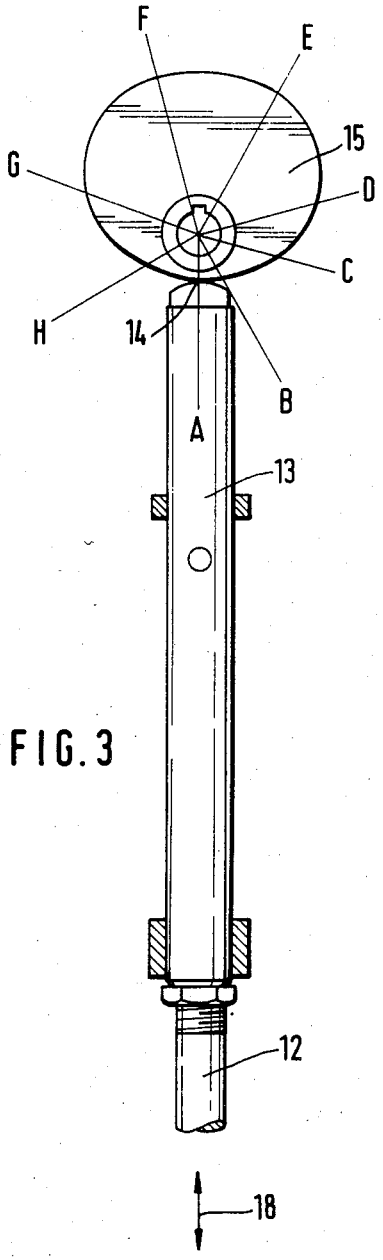
FIG. 3 is a side elevational view of the means for moving the upper tool relative to the lower tool and the workpiece as seen from the left-hand or from the right-hand side of FIG. 1.

The mode of operation of the machine will be explained with continuous reference to FIGS. 2 and 3 which show the cams 28, 15 in their normal angular positions prior to start of a working cycle involving the affixing of two components 60, 70 of a composite article of hardware to each other as well as to that portion of the workpiece 51 which overlies the top surface 50*a* of the platform 50. The cam 15 shares all angular movements of the cam 28 because these cams are non-rotatably mounted on the output shaft 16 of the aforementioned electric motor. Such motor is arranged to rotate the cams 15, 28 in a counter-clockwise direction, as viewed in FIGS. 3 and 2. FIG. 3 shows the plunger 13 in the upper end position because the follower 14 of this plunger tracks that portion of the peripheral surface of the cam 15 which is nearest to the axis of the shaft 16. The motion transmitting member 25 is also located in the upper end position because its follower 26 is disposed at a level above and at a maximum distance from the shaft 16. The movements of the plunger 13 are out of phase with the movements of the member 25 (in spite of the fact that these parts receive motion from one and the same shaft 16) because the configuration of the peripheral surface of the cam 15 deviates from that of the surfaces bounding the endless groove 27 in one side of the cam 28.

Figure 2:
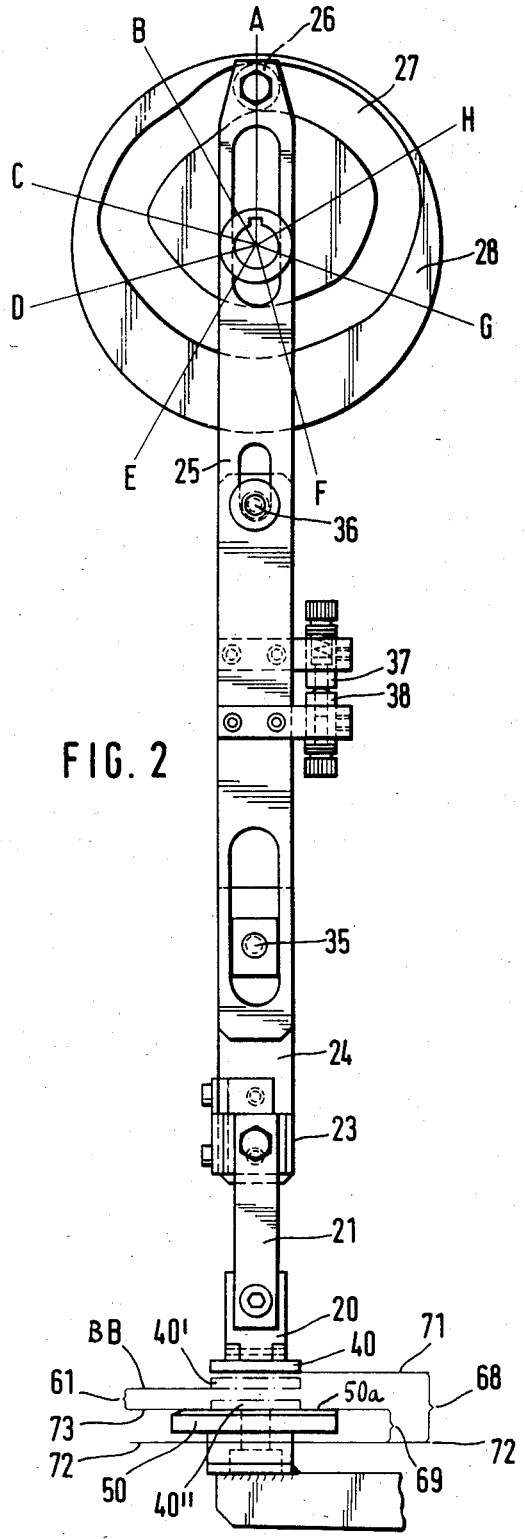
FIG. 2 is a side elevational view of the drive means for moving the grippers jointly toward and away from the supporting means for the workpiece as seen from the right-hand side of FIG. 1.
Figure 7:
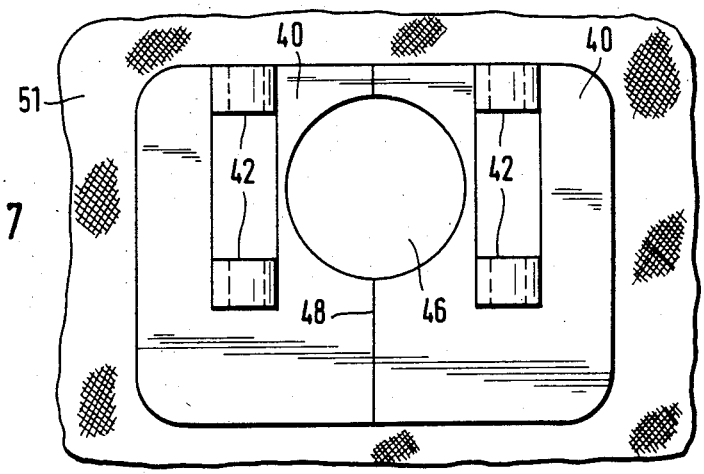
FIG. 7 is a plan view of the structure which is shown in FIG. 5, with the leaf springs for the grippers omitted.

When the cams 15 and 28 assume the angular positions of FIGS. 3 and 2, the block-shaped carriers 20*a* of the grippers 20 are free to contact the shank 47 of the ram 10 because the ram is held in the axial position of FIG. 5 in which a frustoconical end face 65 (see FIG. 8) at the lower end of the spreading cam 63 is spaced apart from and is located at a level above complementary frustoconical faces 64 of the upper portions or followers of the carriers 20*a*, i.e., the leaf springs 21 are free to maintain the side faces 48 of the shoes 40 in actual contact with each other as shown in FIG. 7. At such time, the holding means or sockets 59 of the carriers 20*a* receive and hold a component 60 which is ready to be affixed to the workpiece 51 as well as to a complementary component 70 on the lower tool 54 in the passage 52. The component 59 is delivered to the sockets 59 by a reciprocable pusher (not shown) from the discharge end of a chute (not shown) which, in turn, receives components 60 from a suitable magazine on the frame 100. Reference may be had to the commonly owned copending patent application Serial No.598,990 filed April 11, 1984 ,now abandoned. A similar system can be used to supply components 70 into the passage 52 of the platform 50. The component 60 can constitute a portion of a button having a head and a shank which latter is to penetrate through the material of the workpiece 51 on the platform 50 and into the component 70 on the lower tool 54. The component 70 can constitute a washer or a cap which is permanently joined to the component 60 not later than when the ram 10 reaches the lower end of its stroke.

At the time the motor is about to set the cams 15 and 28 in rotary motion, the platform 50 is held in the upper end position of FIG. 1 by the coil springs 58 which cause the platform to abut against the aforementioned stop or stops of or on the frame 100. The operator in charge of the machine is free to shift the workpiece 51 relative to the platform 50 so as to place a selected portion of the workpiece onto the horizontal top surface 50*a* in the space between the tool 54 and the raised ram 10. The platform 50 can be releasably held in the upper end position of FIG. 1 by a suitable locking device which is not shown in the drawing and which can be disengaged automatically (e.g., in response to starting of the motor for the shaft 16) or by hand.

When the motor is started, the cams 15 and 28 are caused to rotate in a counterclockwise direction, as viewed in FIGS. 3 and 2, through a first angle of approximately or exactly 30 degrees (such angles extend between the lines A and B extending radially from the axis of the horizontal shaft 16). During this first stage of a complete revolution of the cam 15, the extent of downward movement of the plunger 13 is small or negligible because the peripheral surface of the cam 15 causes a relatively slight increase in the distance between the follower 14 and the axis of the shaft 16, i.e., the ram 10 performs a relatively short first portion of its downward stroke. The downward movement of the motion transmitting member 25 for the grippers 20 is more pronounced because the follower 26 travels in a portion of the endless groove 27 which has a pronounced slope toward the axis of the shaft 16, i.e., the grippers 20 move downwardly with reference to the ram 10.

The next stage of a full revolution of the shaft 16 includes an angular movement through approximately or exactly 45 degrees (between the lines B and C shown in FIGS. 2 and 3). At such time, the level of the grippers 20 does not change at all because the roller follower 26 tracks a portion of the groove 27 whose center of curvature is located on the axis of the shaft 16. At the same time, the ram 10 moves downwardly relative to the grippers 20 because the configuration of the peripheral surface of the cam 15 is such that the latter forces the follower 14 of the plunger 13 to move downwardly.

During the first stage of angular movement of the cam 28, the grippers 20 move their shoes 40 from the solid-line positions to the phantom-line positions 40' of FIG. 2, i.e., the undersides of the shoes 40 are located in a horizontal plane BB at a level above the plane of the top surface 50*a* of the platform 50 (which latter is still held in the upper end position). The undersides of the shoes 40 then remain in the plane BB while the cam 28 completes the second stage of its revolution (between the lines B and C); such interval of dwell of the shoes 40 at an unchanged distance from the platform 50 is used to scan the space 61 between the plane BB and the plane of the top surface 50*a* of the platform 50 for the presence of one or more obstacles (such as one or more fingers). If an obstruction is located between the shoes 40 and the upper side of the workpiece 51 on the platform 50 while the shoes 40 descend from the solid-line positions to the phantom line positions 40' of FIG. 2, the electric contact 38 on the motion transmitting member 25 of the safety device 30 is caused to move downwardly and away from the contact 37 on the motion transmitting member 24 so that the motor for the shaft 16 is arrested upon completion of the first stage of angular movement of the cam 28 or immediately thereafter, i.e., before the grippers 20 can move their shoes 40 below the phantom-line positions 40' of FIG. 2. If the space 61 is empty, the shaft 16 continues to rotate the cams 15 and 28 so that these cams can complete the second stage (between the lines B and C) of their angular movement through a total of 360 degrees. The safety device 30 is rendered inactive when the shaft 16 completes an angular movement through 75 degrees (from A to C), and this results in deactivation of the aforementioned locking device which releasably holds the platform 50 in its upper end position. Such locking of the platform 50 in its upper end position is desirable on the ground that the operator can readily shift a selected portion of the workpiece 51 onto the top surface 50*a* while the platform 50 is prevented from moving up and/or down. From then on, the platform 50 continues to remain for a while in the upper end position of FIG. 1 under the action of the coil springs 58 (which urge the platform against a stop on or of the frame 100) but the platform is free to descend in response to the application of a force which overcomes the bias of the springs 58.

At the time of deactivation of the locking means for the platform 50, the distance 33 between the upper end convolution of the coil spring 32 and the adjustable stop 31 has been reduced to zero (as a result of downward movement of the ram 10 relative to the head 23 of the drive means for the grippers 20) and any further downward movement of the ram 10 relative to the grippers 20 entails a compression of the coil spring 32, e.g., through a distance 62 which is indicated in the central portion of FIG. 1.

During the next stage of rotation of the cams 15 and 28 (between the lines C, D and through an angle which equals or approximates 30 degrees), the surfaces flanking the groove 27 of the cam 28 cause the grippers 20 to descend so that the shoes 40 of these grippers move from the phantom-line positions 40' to the phantom-line positions 40'' of FIG. 2 in which they come into contact with the upper side of the selected portion of the workpiece 51 on the top surface 50*a* of the platform 50. If the workpiece 51 is relatively thick, the shoes 40 can engage the upper side of the workpiece 51 on their way from the positions 40' to the positions 40''. This entails a compression of the workpiece 51 on the top surface 50*a* because the selected portion of the workpiece is pushed downwardly by the shoes 40 while the platform 50 is compelled to yield and move downwardly against the opposition of the coil springs 58. The characteristic curves of the springs 32 and 58 are selected in such a way that the bias of the spring 32 is stronger. This means that, once the spring 32 is compressed to the extent shown at 62 in FIG. 1, the axial length of the spring 32 does not decrease any further but the springs 58 are compelled to yield and allow the platform 50 to descend with the selected portion of the workpiece 51 thereon. Thus, the extent to which the selected portion of the workpiece 51 is compacted (when the axial length of the spring 32 cannot be reduced any more) remains unchanged while the platform 50 moves away from its upper end position. The width of the space 61 shown in the lower portion of FIG. 2 is then reduced to zero and the machine is ready to spread or stretch the selected portion of the workpiece 51 preparatory to affixing of the components 60, 70 to the workpiece and to each other.

Figure 4:
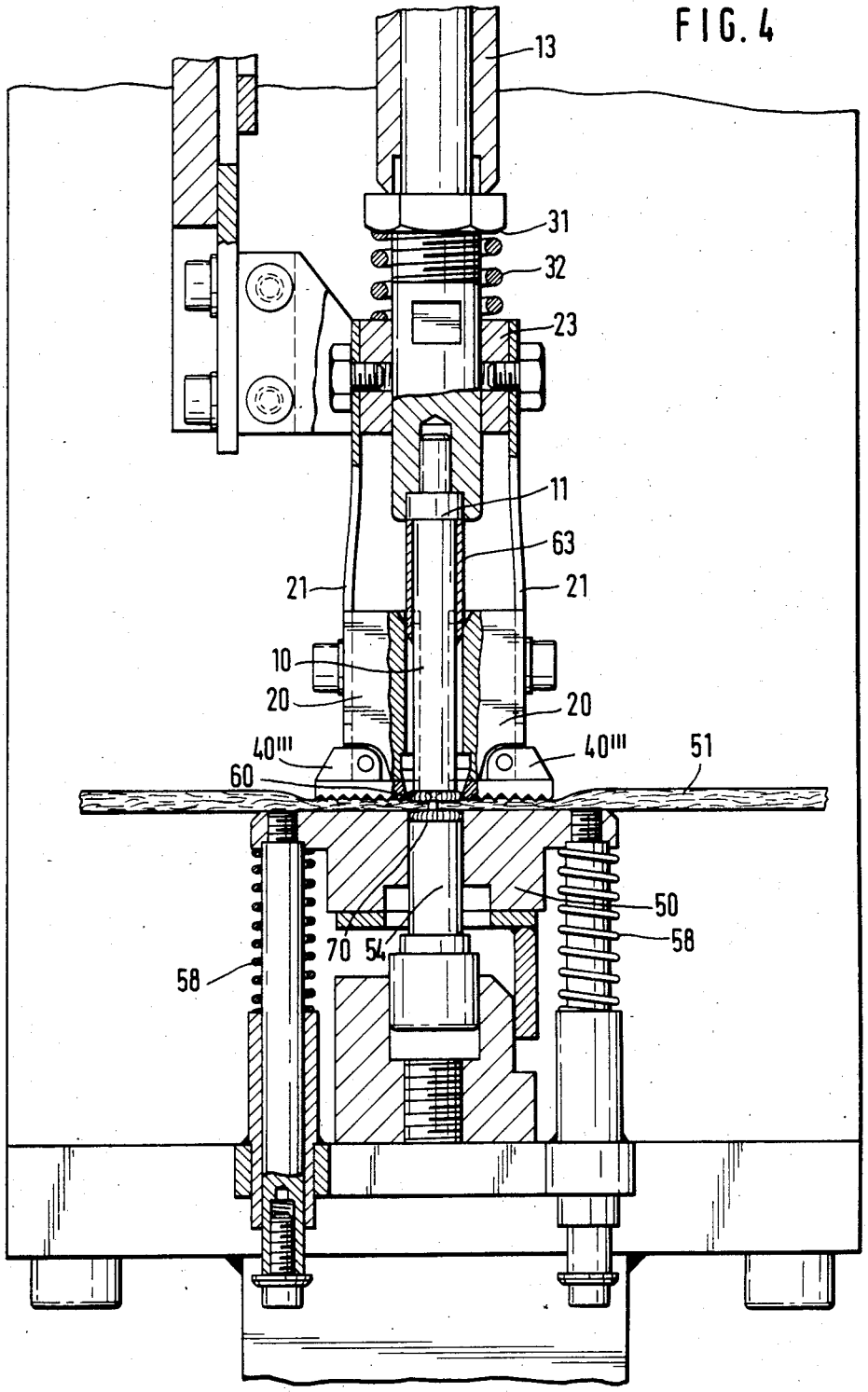
FIG. 4 is an enlarged view of the lower portion of the structure which is shown in FIG. 1, the grippers and the upper tool being shown in engagement with the workpiece on the platform.
Figure 8:
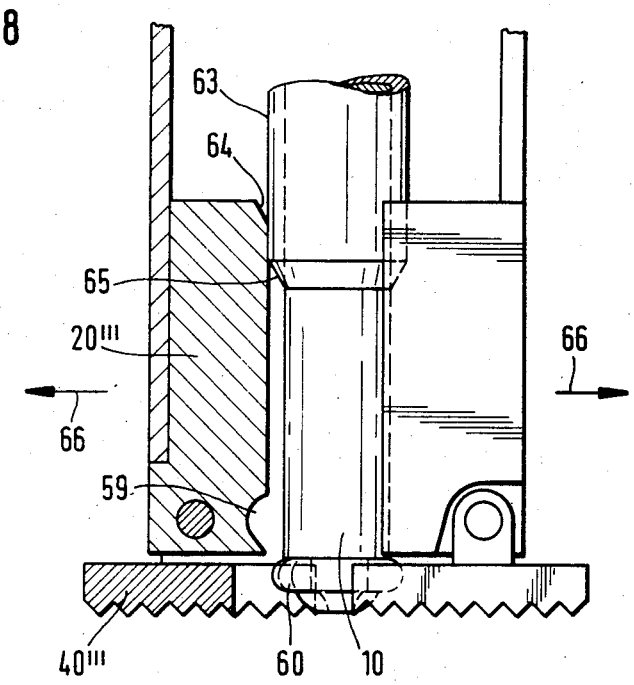
FIG. 8 is a view similar to that of FIG. 5 but showing the grippers in spread-apart positions.
Figure 9:
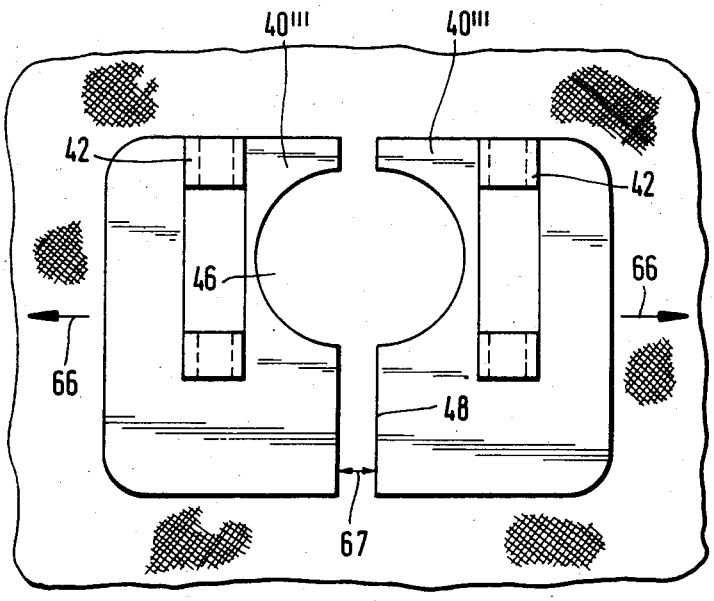
FIG. 9 is a plan view of the structure which is shown in FIG. 8, with the leaf springs for the grippers omitted.

The next stage of rotation of the cams 15 and 28 (between the lines D and E) involves an angular movement of exactly or approximately 45 degrees. At such time, the ram 10 is moved downwardly by the cam 15 and the grippers 20 are moved downwardly by the cam 28. The rate of downward movement of the ram 10 exceeds that of downward movement of the grippers 20 whereby the sleeve-like spreading cam 63 on the shank 47 moves its frustoconical lower end face 65 against the composite frustoconical face 64 of the grippers 20 (whose carriers 20*a* still closely surround the shank 47). This is shown in FIG. 8. The cam 63 spreads the two grippers 20 apart, i.e., the surfaces 22 of the carriers 20*a* move away from the peripheral surface of the shank 47 in the directions indicated by the arrows 66 whereby the serrations 41 of the shoes 40 (which are in pronounced contact with the selected portion of the workpiece 51 on the top surface 50*a* of the platform 50) spread the workpiece in the region above the platform 50 in order to eliminate any folds, pleats and/or similar irregularities. The corresponding (spread-apart) positions of the grippers 20 are shown in FIG. 8, as at 20'''; at such time, the shoes 40 assume the positions 40'''. The character 67 denotes in FIG. 9 the gap between the side faces 48 when the shoes 40 are held in the positions 40'''. Reference may also be had to FIG. 4 which shows the shoes 40 in the spread-apart positions 40'''. The selected portion of the workpiece 51 on the top surface 50*a* of the platform 50 is then in an optimum position for the affixing of the components 60 and 70 thereto as well as for the affixing of such components to each other.

The stage between the lines E and F covers an angle of approximately or exactly 45 degrees. The grippers 20 are then held at a standstill, i.e., their level remains unchanged, but the ram 10 continues to descend so that its tip removes the component 60 from the sockets 59 of the carriers 20*a* and delivers it downwardly against the upper side of the selected portion of the workpiece 51 on the top surface 50*a* of the platform 50. At such time, a portion of the component 60 and/or the component 70 penetrates through the material of the workpiece 51 so that the two components are united into a composite article of hardware. This can be seen in FIG. 4. The shoes 40 of the grippers 20 continue to stretch the material of the workpiece 51 in the region of the application of components 60 and 70. Such application is completed when the ram 10 reaches the lower end of its stroke (somewhere between the lines E and F shown in FIG. 2).

The stretching or flattening action of the shoes 40 upon the workpiece 51 need not be maintained after the application of the components 60, 70 to the workpiece and to each other is completed. Therefore, and as the cams 15 and 28 continue to turn in a counterclockwise direction (as viewed in FIGS. 3 and 2) between the lines F and G (through an angle of exactly or approximately 60 degrees), the ram 10 rises together with the grippers 20 so that the material of the workpiece 51 can contract due to its innate resiliency (if any) as soon as it is released by the serrations 41 at the undersides of the shoes 40.

During the next stage of rotation of the shaft 16 (between the lines G and H), the ram 10 and the grippers 20 continue to move upwardly but at different rates, namely the ram rises more rapidly than the grippers so that the shaft 11 extracts the slecve-like cam 63 from the space between the internal surfaces 22 of the carriers 20*a* with the result that the leaf springs 21 are free to return the carriers 20*a* and their shoes 40 to the positions which are shown in FIG. 5, i.e., the side faces 48 of the shoes 40 are free to abut against each other. The angular movement between G and H is approximately 50 degrees; when such stage of rotation of the shaft 16 is completed, the grippers 20 reach the upper end of their stroke.

The last stage of rotation of the shaft (between the lines H and A through an angle of approximately 55 degrees) completes the full revolution and results in return movement of the ram 10 to its upper end position. At such time, the aforementioned pusher delivers a fresh component 60 into the sockets 59 of the carriers 20*a* so that the machine is ready for the next cycle which can begin as soon as the illustrated workpiece 51 is replaced with a fresh workpiece or as soon as the operator completes the placing of a different portion of the same workpiece into the space above the top surface 50*a* of the platform 50. The freshly inserted component 60 is held in the sockets 59 of the carriers 20*a* under the action of the leaf springs 21 which invariably tend to maintain the side faces 48 of the shoes 40 in the positions of FIG. 7, i.e., in actual abutment with one another. At such time, the internal surfaces 22 of the carriers 20*a* abut against the adjacent portions of the peripheral surface of the shank 47 of the tool 10.

The illustrated work engaging device including the two grippers 20 can be called a tongs because each of the two grippers can be said to constitute one of two jaws. However, it is equally within the purview of the invention to employ a work engaging device which comprises three or more grippers arranged to partially or completely surround the upper tool of the machine. For example, if the machine has a work engaging device with three or four grippers, they can be distributed in the same way as the jaws of a chuck. Moreover, it is even possible to design the work engaging device in such a way that fewer than all of its grippers are movable substantially radially of the upper tool. For example, in its simplest form, the illustrated work engaging device could include a first gripper 20 which is rigidly secured to the head 23 and a second gripper 20 which is movable in and counter to the direction indicated by one of the arrows 66 shown in FIGS. 8 and 9, i.e., in substantial parallelism with the plane of the selected portion of the workpiece 51 on the top surface 50*a* of the platform 50.

Referring again to FIG. 2, the line 71 denotes the uppermost level and the line 72 denotes the lowermost level of the undersides of the shoes 40. Thus, the distance 68 denotes the upward or downward stroke of the work engaging device including the grippers 20. Such distance depends on the configuration of the endless groove 27 in the side face of the cam 28 on the shaft 16. The line 73 denotes the uppermost level of the top surface 50*a* of the platform 50 and the aforementioned line 72 further denotes the lowermost level of such top surface. The distance 69 between the lines 72 and 73 corresponds to the stroke of the platform 50 plus the thickness of the workpiece 51 thereon. The platform 50 maintains its top surface 50*a* at the level of the line 72 during attachment of the components 60, 70 to each other and to the workpiece 51 therebetween.

An important advantage of the improved machine is that the stretching, spreading or flattening of the workpiece 51 on the platform 50 can be carried out in a very simple and inexpensive way by designing and mounting the work engaging device in such a way that its grippers 20 perform an additional function. Thus, instead of merely engaging and immobilizing the workpiece 51 during the application of an article of hardware thereto and/or instead of merely serving as a means for supporting a component (60) of an article of hardware in the path of movement of the adjacent tool (ram 10) and/or instead of merely serving as elements of the safety device 30, the grippers 20 of the improved machine further perform the novel function of spreading or flattening the workpiece 51 and of maintaining the workpiece in such desirable condition during the application of one or more components of an article of hardware thereto. All this is achieved by the simple expedient of providing means for spreading the grippers of the work engaging device by moving at least one of two or more grippers away from each other gripper preparatory to final descent of the ram 10 into actual engagement with the component 60 which is held by the grippers 20 in a position of readiness for the application to the selected portion of the workpiece 51, namely to the portion which overlies the top surface 50*a* of the platform 50. It has been found that the provision of a work engaging device which can stretch, flatten or spread the workpiece preparatory to and during the application of one or more components of an article of hardware enhances the appearance of the product and also ensures that the article is properly affixed to the workpiece and that its components (if the article comprises several components) are reliably affixed to one another.

The provision of composite grippers, which comprise carriers and shoes articulately connected to the respective carriers, has been found to ensure more predictable flattening or stretching of the workpiece because the entire underside of each shoe can remain in full surface-to-surface contact with the workpiece while the shoes are caused to move away from each other and away from the respective tool. The provision of shoes with serrated or otherwise roughened work-contacting surfaces also contributes to more predictable flattening and smoothing of the workpiece in the region between the tools 10 and 54. It has been found that simple ribs or rows of teeth or analogous projections or protuberances which extend at right angles to the directions indicated by the arrows 66 of FIG. 8 can invariably ensure adequate expansion of the material of the workpiece prior to the application of one or more components of an article of hardware thereto. Thus, the ribs or rows of teeth should preferably extend at right angles to the direction of movement of the respective shoes away from the respective tool.

It is further conceivable and possible to employ other means for spreading the grippers 20 or analogous grippers after their shoes 40 engage the adjacent side of the workpiece 51 on the platform 50. For example, one could resort to electromagnets which are actuated by proximity switches or pressure-responsive switches which generate signals when the grippers move sufficiently close to the platform 50 to warrant their movement away from one another and from the tool 10. However, the illustrated spreading means (with a simple sleeve-like cam 63 receiving motion from a second cam, namely from the disc cam 27) is preferred at this time because it is simple, reliable, compact and inexpensive. The placing of the spreading cam 63 onto the shank 47 of the tool 10 takes advantage of the fact that, in the illustrated machine, the movements of the ram 10 are out of phase with the movements of the grippers 20 so that the cam 63 can readily perform the required spreading action as soon as the shoes 40 of the grippers 20 come into requisite frictional engagement with the upper side of the workpiece 51 on the platform 50. Thus, it is not necessary to provide a discrete prime mover to power the spreading means for one or more shoes 40 because the prime mover which drives the shaft 16 can also impart necessary movements to the movable shoe(s) 40 through the medium of the cams 27 and 63. This contributes to simplicity and compactness of the improved machine.

It is further possible to provide spreading means which is positively coupled with the radially movable shoe or shoes 40. However, the provision of leaf springs 21 or analogous biasing means renders it possible to employ a spreading device in the form of a simple radial enlargement or cam 63 on the upper tool or on the means for reciprocating the upper tool because the springs 21 invariably tend to maintain the grippers 20 in the positions of FIGS. 5 to 7, i.e., as close to the ram 10 as possible.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A machine for securing components of articles of hardware to sheet-like workpieces, particularly a press for applying components of rivets or the like to textile materials, comprising means for movably supporting in a predetermined plane that portion of a workpiece which is to be provided with at least one component of an article of hardware; work engaging means disposed at one side of said plane opposite said supporting means and including a plurality of grippers movable toward and away from said plane and arranged to hold a component during movement toward said plane, at least one of said grippers being further movable toward and away from each other gripper in substantial parallelism with said plane about an axis which is substantially parallel to said plane, each of said grippers including a carrier, a work-engaging shoe having a work-engaging face, and means for articulately connecting said shoe to the carrier for movement about an axis which is substantially parallel to said plane so that the work-engaging face can lie at least substantially flush against that portion of the workpiece which is located in said plane, said shoes normally abutting each other and together defining an opening larger than and in register with the component which is held by said grippers to allow such component to pass therethrough; drive means for moving said grippers jointly toward and away from said plane and for maintaining said shoes in engagement with the portion of a workpiece in said plane for a selected interval of time; spreading means for moving said at least one gripper and its shoe away from each other gripper while said shoes engage the workpiece so that the shoes stretch the portion of the workpiece in said plane during said interval; and means for affixing at least one component of an article of hardware to the stretched portion of the workpiece during said interval, said affixing means comprising a tool which is disposed at said one side of said plane and is reciprocable toward and away from the portion of a workpiece in said plane, and means for reciprocating said tool, said reciprocating means including a shaft for said tool and means for reciprocating said shaft, said spreading means comprising a sleeve which is fixed to and surrounds said shaft.

2. A machine for securing components of articles of hardware to sheet-like workpieces, particularly a press for applying components of rivets or the like to textile materials, comprising means for movably supporting in a predetermined plane that portion of a workpiece which is to be provided with at least one component of an article of hardware; work engaging means disposed at one side of said plane opposite said supporting means and including a plurality of grippers movable toward and away from said plane and arranged to at hold a component during movement toward said plane, at least one of said grippers being further movable toward and away from each other gripper in substantial parallelism with said plane about an axis which is substantially parallel to said plane; drive means for moving said grippers jointly toward and away from said plane and for maintaining said grippers in engagement with the portion of a workpiece in said plane for a selected interval of time; spreading means for moving said at least one gripper away from each other gripper while said grippers engage the workpiece so that the grippers stretch the portion of the workpiece in said plane during said interval; and means for affixing at least one component of an article of hardware to the stretched portion of the workpiece during said interval, each of said grippers including a carrier and a work-engaging shoe having a work-engaging face and articulately connected to the carrier, said shoes defining an opening for a portion of said affixing means and said spreading means including means for moving said shoes from first positions in which said shoes abut against each other to second positions in which such shoes are spaced apart from one another and from said portion of said affixing means, said opening being in register with the workpiece which is held by said grippers and being larger than such workpiece.

3. A machine for securing components of articles of hardware to sheet-like workpieces, particularly a press for applying components of rivets or the like to textile materials, comprising means for movably supporting in a predetermined plane that portion of a workpiece which is to be provided with at least one component of an article of hardware; work engaging means disposed at one side of said plane opposite said supporting means and including a plurality of grippers movable toward and away from said plane and arranged to hold a component during their movement toward said plane, at least one of said grippers being further movable toward and away from each other gripper in substantial parallelism with said plane, each of said grippers including a carrier, a work-engaging shoe having a work-engaging face, and means for articulately connecting said shoe to the carrier for movement about an axis which is substantially parallel to said plane so that the work-engaging face can lie at least substantially flush against that portion of the workpiece which is located in said plane, said shoes normally abutting each other and together defining an opening larger than and in register with the component which is held by said grippers to allow such component to pass therethrough; drive means for moving said grippers jointly toward and away from said plane and for maintaining the shoes of said grippers in engagement with the portion of a workpiece in said plane for a selected interval of time; spreading means for moving said at least one gripper and its shoe away from each other gripper and its shoe while said shoes engage the workpiece so that the shoes stretch the portion of the workpiece in said plane during said interval; and means for affixing at least one component of an article of hardware to the stretched portion of the workpiece during said interval.

4. The machine of claim 3, wherein said connecting means includes means for pivotably securing said shoe to said carrier.

5. The machine of claim 3, wherein said work-engaging face is provided with work-contacting protuberances.

6. The machine of claim 3, wherein said affixing means includes a tool which is disposed at said one side of said plane, which is reciprocable toward and away from the portion of the workpiece in said plane and which is at least partially surrounded by said grippers, said affixing means further comprising means for reciprocating said tool, said spreading means being provided on said reciprocating means and said reciprocating means including a shaft having a peripheral surface and supporting said tool, carrier, said carriers having surfaces normally abutting against said peripheral surface and said spreading means including a cam provided on said shaft and arranged to move said carriers radially of and away from the axis of said shaft in response to movement of said tool toward said plane.

7. The machine of claim 3, further comprising resilient means including at least one leaf spring for coupling said at least one gripper to said drive means so that said at least one gripper is movable away from but is biased toward each other gripper.

8. The machine of claim 3, wherein said drive means includes a rotary cam and said spreading means includes a second cam receiving motion from said rotary cam.

9. The machine of claim 3, wherein said affixing means comprises a tool which is disposed at said one side of said plane, which is reciprocable in directions toward and away from said plane and which is at least partly surrounded by said grippers.

10. The machine of claim 9, wherein said grippers include means for releasably holding a component in front of said tool so that, when said tool is moved toward said plane, it removes the component from said holding means and applies it to the portion of the workpiece in said plane.

11. The machine of claim 10, wherein said drive means includes means for moving said grippers jointly toward and into engagement with the portion of the workpeice in said plane prior to removal of a component from said holding means by said tool and said spreading means includes means for maintaining said at least one gripper away from each other gripper while said tool removes a component from said holding means and affixes it to the stretched portion of workpiece in said plane.

12. The machine of claim 3, further comprising means for coupling said grippers to said drive means, said coupling means including resilient means securing said at least one gripper to said drive means.

13. The machine of claim 12, wherein said resilient means includes at least one spring arranged to urge said at least one gripper toward each other gripper.

14. The machine of claim 13, wherein said spreading means includes cam means, follower means provided on said at least one gripper, and means for moving said cam means relative to said follower means to thereby move said at least one gripper away from each other gripper against th opposition of said spring.

15. The machine of claim 3, wherein said spreading means includes cam means, means for moving said cam means relative to said at least one gripper and follower means provided on said at least one gripper and arranged to track said cam means.

16. The machine of claim 15, wherein said affixing means includes a tool which is disposed at said one side of said plane and is reciprocable toward and away from the portion of the workpiece in said plane, said means for moving said cam means including means for reciprocating said tool and said tool being at least partially surrounded by said grippers.

17. The machine of claim 16, wherein said reciprocating means includes a reciprocable shaft and said cam means is affixed to and shares the reciprocatory movements of said shaft.

18. The machine of claim 17, wherein said cam means includes an enlarged portion of said shaft, said enlarged portion having a substantially conical front end face and said at least one gripper having a complementary face which constitutes said follower means and is engaged by said front end face in response to movement of said shaft and said tool toward said plane.

19. The machine of claim 18, wherein said enlarged portion includes a sleeve.

20. The machine of claim 3, wherein said supporting means includes a platform having a passage extending to said plane and said affixing means includes a tool installed in said passage opposite said work engaging means.

21. The machine of claim 20, wherein said platform is movable with said plane and the workpiece thereon relative to said tool in directions at least substantially at right angles to said plane.

22. The machine of claim 20, wherein said affixing means further comprises a second tool disposed at said one side of said plane opposite and in register with the tool in said passage, and means for reciprocating said second tool toward and away from the tool in said passage so that a selected component which is placed between one of said tools and the portion of the workpiece in said plane is affixed to such portion of the workpiece in response to movement of said second tool toward said passage.

23. The machine of claim 22, wherein said reciprocating means includes means for moving said second tool relative to said work engaging means.

* * * * *